US011600479B2

(12) United States Patent
Wright et al.

(10) Patent No.: US 11,600,479 B2
(45) Date of Patent: Mar. 7, 2023

(54) SYSTEM AND METHOD FOR DETECTING ANALYTES DISSOLVED IN LIQUIDS BY PLASMA IONISATION MASS SPECTROMETRY

(71) Applicant: Microsaic Systems PLC, Woking (GB)

(72) Inventors: Steven Wright, Woking (GB); Eric Yeatman, Woking (GB); Edward Crichton, Woking (GB)

(73) Assignee: Microsaic Systems PLC, Woking (GB)

( * ) Notice: Subject to any disclaimer, the term of this patent is extended or adjusted under 35 U.S.C. 154(b) by 0 days.

(21) Appl. No.: 17/781,007

(22) PCT Filed: Nov. 26, 2020

(86) PCT No.: PCT/EP2020/083559

§ 371 (c)(1),
(2) Date: May 30, 2022

(87) PCT Pub. No.: WO2021/110542

PCT Pub. Date: Jun. 10, 2021

(65) Prior Publication Data

US 2022/0415639 A1 Dec. 29, 2022

(30) Foreign Application Priority Data

Dec. 6, 2019 (GB) ..... 1917885

(51) Int. Cl.
*H01J 49/00* (2006.01)
*H01J 49/04* (2006.01)
*H01J 49/10* (2006.01)

(52) U.S. Cl.
CPC ..... *H01J 49/0422* (2013.01); *H01J 49/105* (2013.01)

(58) Field of Classification Search
CPC ..... H01J 49/0422; H01J 49/105
(Continued)

(56) References Cited

U.S. PATENT DOCUMENTS

2017/0365455 A1* 12/2017 Hendrikse ..... H01J 49/0404
2018/0033602 A1 2/2018 Berkout et al.
(Continued)

OTHER PUBLICATIONS

ISR/WO from PCT/EP2020/083559.
(Continued)

*Primary Examiner* — Michael Maskell
(74) *Attorney, Agent, or Firm* — Stephen T. Scherrer; Monique A. Morneault; Scherrer Patent & Trademark Law, P.C.

(57) ABSTRACT

Bubble plasma ionisation probe for analysing liquids by mass spectrometry. A means of a detecting analytes dissolved in a liquid by mass spectrometry is described. Gas flows from a source through a first conduit 105 and thereafter through a coaxial second conduit 103 that also serves as the inlet to the mass spectrometer 102. The coaxial arrangement of conduits is submerged in the liquid to be analysed 301. Using a feedback loop, the gas pressure is adjusted and controlled such that an attached bubble 302 forms at the open end of the first conduit 105. A plasma 305 is provided in the bubble. The plasma is preferably generated by a dielectric barrier discharge between a collar electrode 107 and mass spectrometer inlet 103. Analytes dissolved in the liquid are both desorbed form the gas-liquid interface and ionised by the action of the plasma. Ions formed in this way become entrained in the gas flow and are consequently transferred to the mass spectrometer, where they are analysed.

45 Claims, 13 Drawing Sheets

(58) Field of Classification Search
USPC ..... 250/281, 282, 288
See application file for complete search history.

(56) References Cited

U.S. PATENT DOCUMENTS

| | | | |
|---|---|---|---|
| 2019/0157059 | A1 | 5/2019 | Jones et al. |
| 2019/0234837 | A1 | 8/2019 | Van Berkel |

OTHER PUBLICATIONS

Bruggeman P.J. et al: "Plasma-liquid interactions: a review and roadmap," Plasma Sources Science and Technology, Institute of Physics Publishing, Bristol, GB, vol. 25, No. 5, Sep. 30, 2016, whole document.

* cited by examiner

Prior Art

SYSTEM AND METHOD FOR DETECTING ANALYTES DISSOLVED IN LIQUIDS BY PLASMA IONISATION MASS SPECTROMETRY

FIELD OF THE INVENTION

The present invention relates to the detection of analytes dissolved in a liquid using a plasma to generate gas phase ions and subsequently analysing said ions with a mass spectrometer. The invention more particularly relates to a method and system that provides a plasma within a gas bubble attached to an arrangement of co-axial gas conduits submerged in the liquid.

BACKGROUND

Mass spectrometry (MS) is a sensitive technique used in the field of chemical analysis to detect, identify, and characterise molecules. Typically, the molecule of interest (the analyte) is mixed with a matrix such as a solvent or deposited on a substrate. A means of releasing or desorbing the analyte from the matrix or substrate, and a method of ionising the analyte are required. The resulting positively or negatively charged ions may then be separated according to their mass (specifically, their mass-to-charge ratio, m/z) by a mass analyser employing electric fields, magnetic fields, or combinations thereof, and subsequently detected by an ion detector. Mass analysers operate at very low pressures (vacuum conditions) to ensure that the trajectories of the ions are dominated by the applied fields rather than by collisions with neutral gas molecules. However, it is often convenient to perform ionisation at atmospheric pressure. When this is the case, a flow of ambient gas and entrained ions from the ion source is drawn into the vacuum system through a small aperture or capillary tube.

Electrospray ionisation (ESI) is the most common method of analysing liquid solutions. This technique requires that a sample of the liquid is delivered via capillary tubing to a sharp tip. In response to an applied electric field, a fine jet of liquid is ejected from the tip, which subsequently breaks up into a plume of charged droplets. Wholly aqueous solutions do not spray well, as the surface tension of water is high. Typically, an organic solvent that is miscible with water, such as acetonitrile or methanol, is added to reduce the surface tension.

Analyte ions are released into the gas phase following a process of solvent evaporation and droplet fissioning. These ions are then drawn into the mass spectrometer inlet and subsequently analysed.

Despite its widespread use, ESI-MS is often inconvenient and problematic. At the very least, a means of withdrawing a sample from a vessel or diverting a sample from a continuous flow must be devised. An extraction or dilution step may be required as even moderate concentrations of dissolved salts and other involatile solutes are known to deposit on mass spectrometer inlets and ion optics, resulting in loss of sensitivity. Preparation of the sample in a solvent system compatible with ESI, desirably comprising an organic component and an acidic or basic chemical modifier, adds further laborious chemical handling. Filtering of the solution may be necessary as particulates tend to block the ESI capillary. If multiple solutes are present, it is common practice to first separate the components by liquid chromatography (LC) in order to negate the effects of ion suppression. Hence, a person of skill in the art will understand that analysis by ESI-MS involves delays, multiple manual or automated processing steps, use of chemical consumables, and additional equipment. It will also be appreciated that ESI-MS is a destructive technique; the liquid sample is consumed and cannot be recovered. While this is of little consequence when a plentiful supply of liquid is available, in some applications, for example, microfluidic processing, the loss may be unacceptable.

It is clear from the foregoing discussion that applications demanding prompt and convenient detection of analytes in solution are not well-served by conventional ESI-MS. There is, therefore, a need for a more rapid and direct means of analysing liquid solutions.

A suite of techniques known as ambient ionisation mass spectrometry have the desired attributes. Ambient ionisation refers to ionisation performed at atmospheric pressure without any sample preparation, and typically also without chromatographic separation. There are now very many examples of ambient ionisation techniques, offering different means of firstly releasing the analyte from the substrate and secondly, ionising the analyte. Analytes are generally desorbed from solid surfaces using lasers, plasmas, or liquid extraction. Clearly, the analyte of interest must be present near or on the surface, which is frequently the case. Although relatively uncommon, liquid surfaces can also be probed using these desorption techniques. However, the analysis is then not necessarily representative of analytes dissolved in the bulk liquid. Atmospheric oxidation, thermal and concentration gradients, frothing, floating precipitates, and phase separation are all commonplace and likely to compromise the analytical value of the mass spectra recorded. More importantly, the task of presenting a surface for analysis when the liquid of interest is flowing in pipes or stored in vats is not trivial. Liquids can also be presented for ambient ionisation as a jet or a mist of nebulised droplets. However, as with ESI, this requires a means of withdrawing or diverting a sample, which is then permanently lost.

Hence, there is a need for a new ionisation probe for bulk liquids that overcomes the drawbacks and limitations of traditional ESI and existing ambient ionisation techniques.

SUMMARY

The present teachings provide a probe, a system, and a method that conveniently facilitate the analysis of liquid solutions by mass spectrometry without the need for sample preparation or removal of liquid aliquots. The inventors have realised that a plasma provided in a bubble attached to a submerged probe will release and ionise analytes present at the gas-liquid interface. These gas phase ions may then be extracted and analysed by a mass spectrometer.

The invention has several important advantages over prior art systems and methods for analysing liquids by mass spectrometry:

(i) There are no delays associated with the removal of a liquid sample from a vessel or diverting a portion of a flow stream. The plasma probe is inserted directly into the liquid volume and ionisation is performed in situ. Analysis occurs quickly as the technique involves the rapid transfer of gas phase ions rather than the slow flow of liquid through tubing.

(ii) The chemical profile determined by the analysis is representative of the bulk liquid.

(iii) The liquid does not need to be presented as a free surface, jet, or nebulised spray.

(iv) The liquid may be pressurised.

(v) The technique is non-destructive in that the liquid sample is not consumed during analysis.

An exemplary embodiment of a probe provided in accordance with the present teaching comprises an arrangement of open-ended coaxial gas conduits that may be at least partially submerged or immersed in the liquid to be analysed. Pressurised gas passes through the first conduit and thereafter through the second conduit, which also serves as the inlet to the mass spectrometer. The gas pressure or flow rate is adjusted such that a gas bubble forms at the open end of the first conduit, which prevents liquid being drawn into the mass spectrometer. A plasma is generated by a discharge between two electrodes, at least one of which may be provided as part of the probe. The reactive and energetic species produced in and by the plasma interact with analytes present at the gas-liquid interface defined by the bubble, resulting in their release and ionisation. Ions formed in this way become entrained in the gas flow and are consequently drawn into the mass spectrometer, where they are analysed.

If the gas pressure is too high, a stream of bubbles will issue from the open end of the first conduit and the signal will be intermittent. If the gas pressure is too low, liquid will be drawn into the mass spectrometer. Hence, a mechanism is desirably provided to control the gas pressure such that the bubble size remains stable. A feedback loop comprising a transducer and a control module is described. The transducer generates an electrical signal related to the size of the bubble and the control module varies the applied gas pressure or gas flow rate accordingly. Fail-safe mechanisms that prevent liquid being drawn into the mass spectrometer in the event of insufficient gas flow are also presented.

In a preferred embodiment, a low temperature or non-equilibrium plasma is generated by a dielectric barrier discharge. Low temperature plasmas do not cause significant heating and may even be applied to biological materials. However, it is also recognised that plasmas generated by other mechanisms may be advantageous in alternative embodiments of the invention.

In certain configurations the probe may be co-operable with a low dead-volume flow cell. In such an arrangement, the bubble can be inflated in a shallow cavity and the liquid to be analysed flows either side. The flow cell is intended for sampling liquid streams when the flow rate is relatively low, for example, the outflow from a chromatography system.

Accordingly, the present teaching provides a probe, a system and a method as defined in the independent claim. Advantageous features are provided in the dependent claims.

Figure 1:
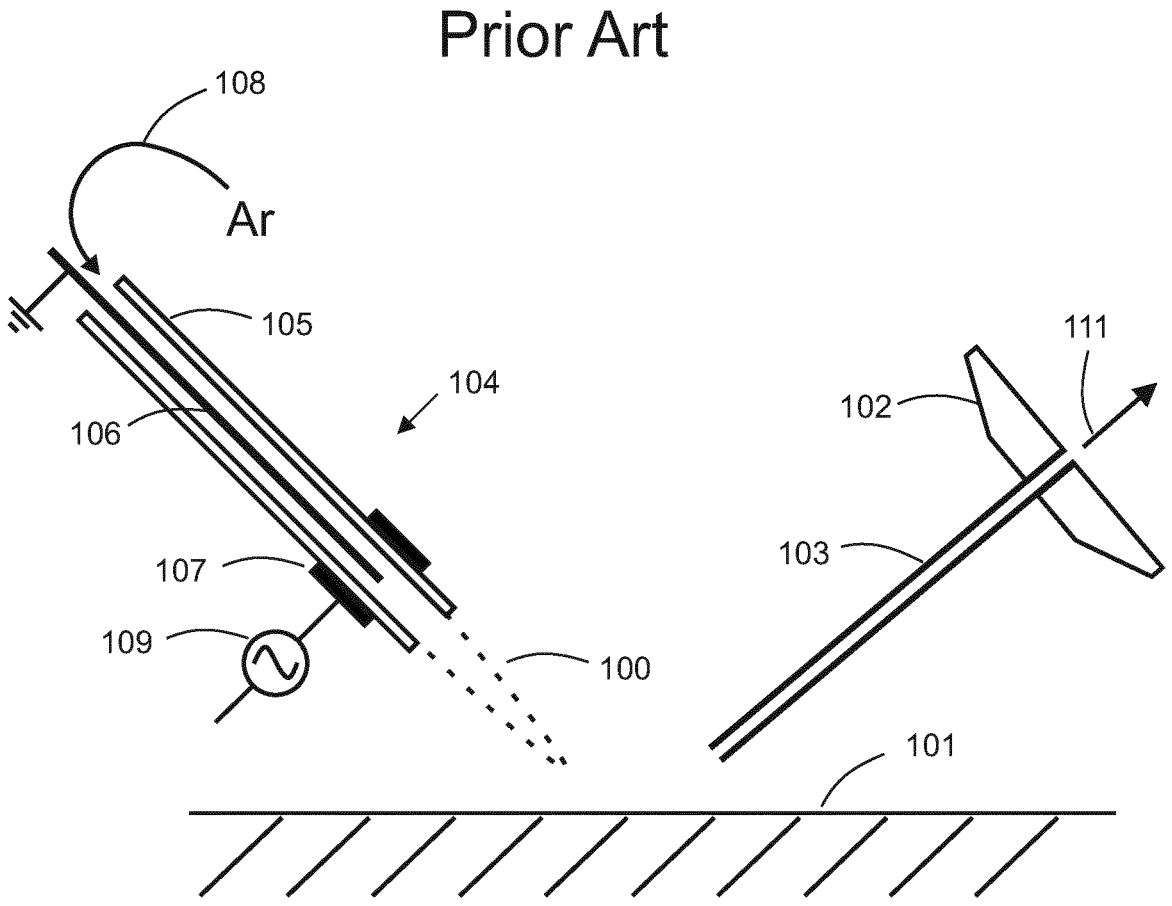
FIG. 1 shows a prior art ambient ionisation system in which a plasma jet is used to desorb and ionise analytes.

The same reference numerals have been used throughout the drawings and following description to refer to the same or like components. Features of the drawings have not necessarily been drawn to scale. In the interests of clarity, not all of the routine features of the implementations described herein are shown or described.

DETAILED DESCRIPTION OF THE DRAWINGS

FIG. 1 shows a prior art ambient ionisation system in which a plasma source operates separately from a mass spectrometer, as described in patent application US 2011/0042560A1. The plasma jet 100 impinges on a surface 101 where it causes desorption and ionisation of analytes. As the mass spectrometer 102 is pumped and operates under vacuum conditions, ambient gas is drawn through the mass spectrometer inlet capillary 103. Gas phase analyte ions generated by the plasma jet 100 become entrained in the gas flow and are consequently transferred to the mass spectrometer 102, where they are analysed.

The plasma jet source 104 comprises a dielectric tube 105, an inner electrode 106, and an outer collar electrode 107. Gas 108 flows through the dielectric tube 105. Operably, the inner electrode 106 is connected to electrical ground while an alternating current (ac) waveform is applied to the outer collar electrode 107. The applied ac waveform 109, which typically has an amplitude of several kilovolts, initiates and maintains a dielectric barrier discharge within the dielectric tube 105. The flow of gas and the electric field established by the electrodes causes the plasma generated by the discharge to extend as a jet or torch 100 from the open end of the dielectric tube 105. The gas flow 108 is adjusted to give a stable jet of the required size and is independent of the gas flow 111 through the mass spectrometer inlet 103.

This system has been used to analyse liquids, as reported by Harper, J. D.; Charipar, N. A.; Mulligan, C. C.; Zhang, X.; Cooks, R. G.; and Ouyang, Z. in *Analytical Chemistry,* 80, 2008, 9097-9104. The plasma jet was directed at the free surface of an aqueous solution of atrazine contained in a dish. With the mass spectrometer inlet capillary positioned nearby, protonated atrazine was detected at m/z 216.

Figure 2:
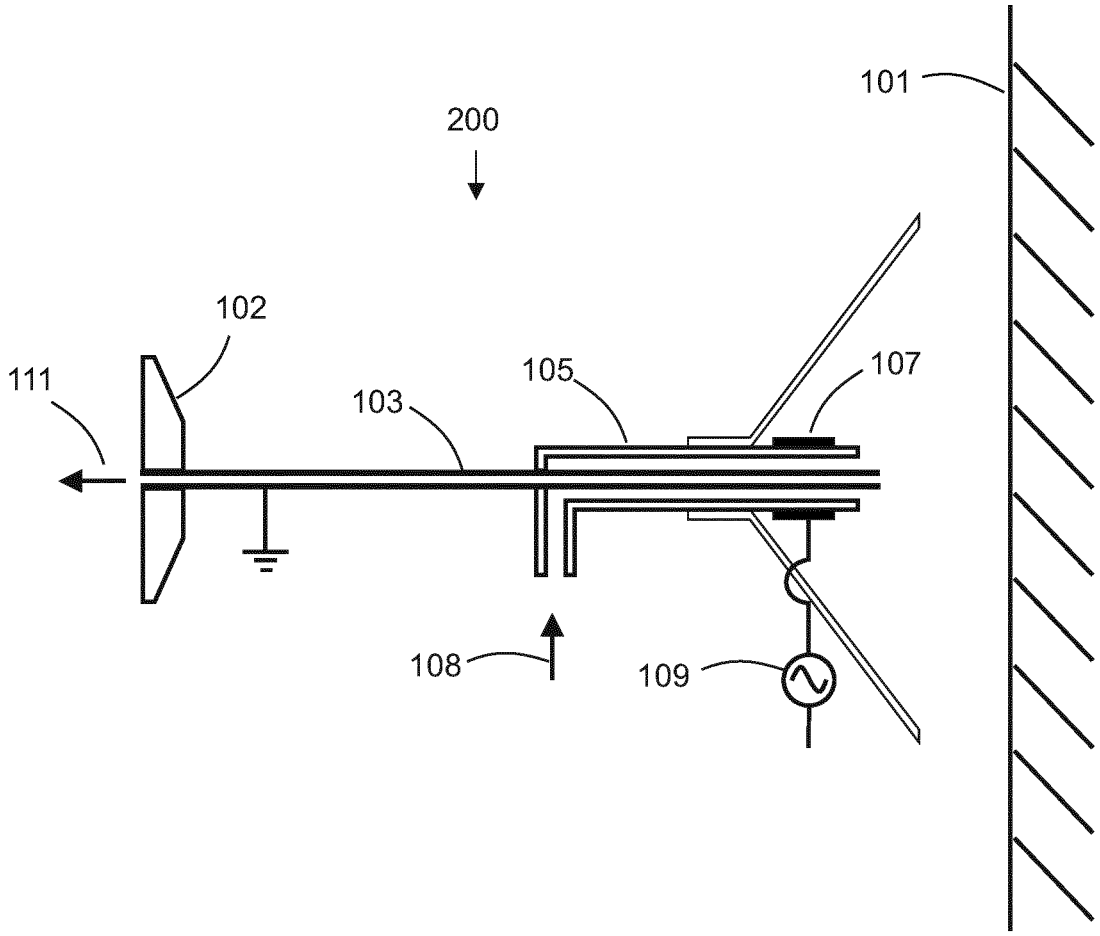
FIG. 2 shows a prior art plasma jet ionisation system in which the mass spectrometer inlet capillary serves as the inner electrode.

FIG. 2 shows a prior art ambient ionisation system in which a plasma source and mass spectrometer inlet are provided as a single, integrated unit 200, as described by Hendricks, P. I.; Dalgleish, J. K.; Shelley, J. T.; Kirleis, M. A.; McNicholas, M. T.; Li, L.; Chen, T.-C.; Chen, C.-H.; Duncan, J. S.; Boudreau, F.; Noll, R. J.; Denton, J. P.; Roach, T. A. Ouyang, Z.; and Cooks, R. G. in *Analytical Chemistry,* 86, 2014, 2900-2908. Gas 108 flows through an outer tube 105 and an ac waveform 109 is applied to an outer collar electrode 107, as in FIG. 1. However, in this case, the mass spectrometer inlet capillary 103 is provided within the outer tube 105, where it also serves as the central ground electrode. Analyte ions formed when the plasma jet interacts with the surface 101 are drawn through the open distal end of the mass spectrometer inlet capillary 103, which is positioned just beyond the end of the outer tube 105. The gas flow 108 is adjusted to give a stable jet of the required size and is independent of the gas flow 111 through the mass spectrometer inlet 103. Demonstrated applications of this prior art system include detection of explosives and illicit drugs deposited on cardboard, paper, fingers, gloves, cotton, and glass melting point tubes.

Figure 3:
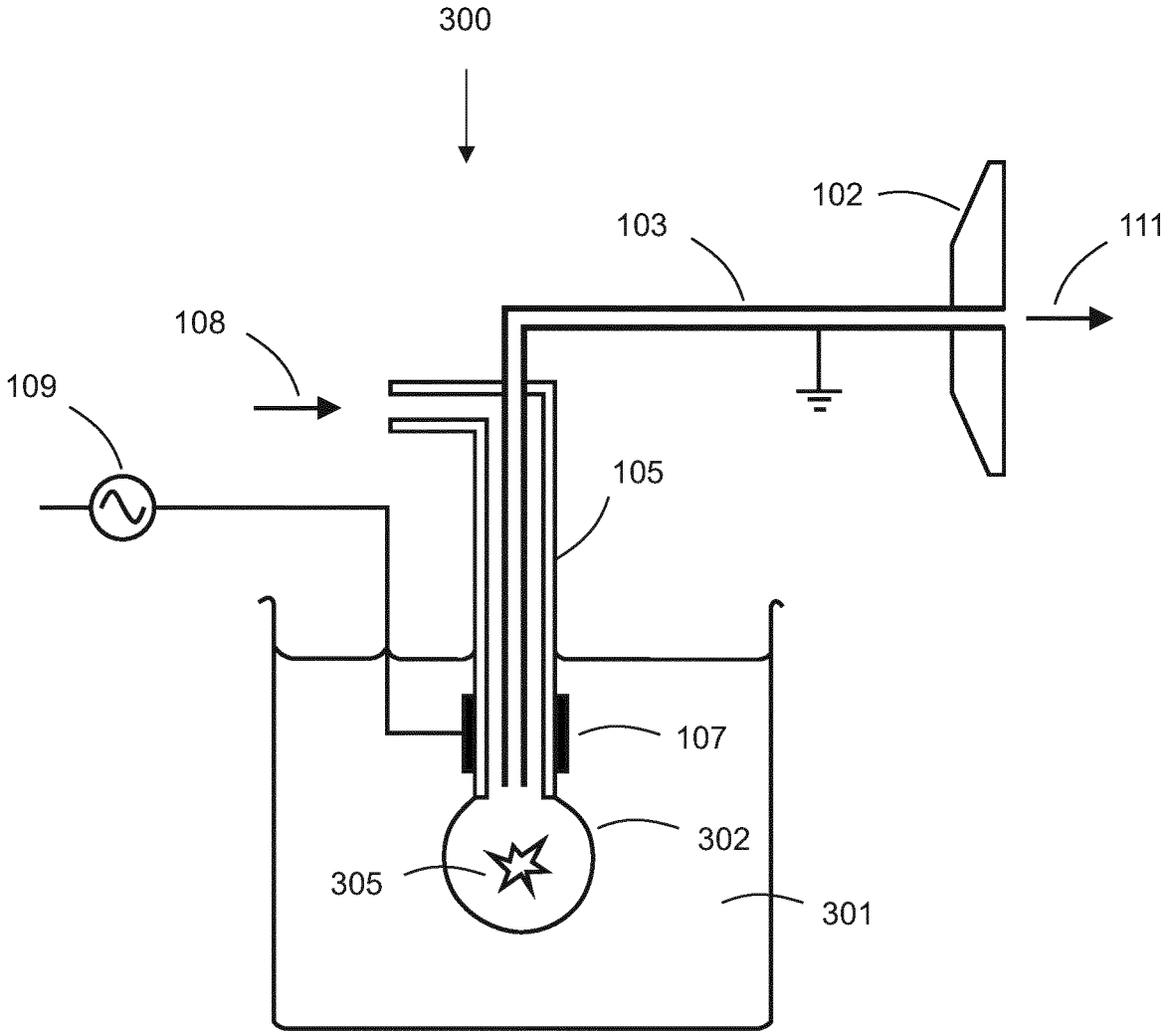
FIG. 3 shows a preferred plasma ionisation system provided in accordance with the present invention.

A schematic representation of a first embodiment of a probe that may be incorporated into an analysis system provided in accordance with the present teaching is shown in FIG. 3. Gas 108 flows through a first gas conduit of the probe configured as an outer tube 105. A plasma generator comprising one or more electrodes, a power supply, and connecting wires is provided. In FIG. 3, a power supply 109 applies an ac waveform to an outer collar electrode 107. A second gas conduit of the probe is configured as the mass spectrometer inlet capillary 103 and is provided coaxially with the first conduit 105, where it also serves as the central grounded electrode.

Operably, the plasma probe 300 is submerged in a liquid to be analysed 301 and a gas bubble 302 is allowed to form at the open end of the first conduit 105. Exemplary bubble sizes include about 1 μm, about 10 μm, about 100 μm, about 1 mm, about 1 cm, and about 10 cm. It will be appreciated that the probe has a sampling region and the bubble is located at that sampling region and extends across an orifice that is defined at the sampling region, typically at the exit of the first gas conduit. The attachment of the bubble to the probe can be considered as a closed contact line defined by the locus of a point at which the probe, liquid, and gas are coincident. The contact line may be pinned or anchored to the rim of the first conduit. Operably, the pressure or flow rate of the supplied gas 108 is adjusted such that the bubble remains attached to the first conduit 105. Suspended solids and other inhomogeneous materials including catalysts, precipitates, particulates and cells, may be present in the liquid to be analysed 301.

While the configuration shown in FIG. 3 is a preferred embodiment of the invention, the present teachings also include an arrangement in which gas flows through a first gas conduit configured as an inner tube located within a second gas conduit configured as the mass spectrometer inlet. It will be understood that the present teachings include configurations in which the first and second gas conduits are not coaxial. The longitudinal axes of the first conduit 105 and second conduit 103 may be displaced such that the latter is not centrally located. Furthermore, the second conduit 103 may be provided in a serpentine form or as a coil. In an alternative embodiment, the second conduit 103 may be replaced by two or more conduits, each providing a flow path from the bubble to the mass spectrometer 102. In a second alternative embodiment, the second conduit 103 is located next to the first conduit 105 rather than within it, and the bubble is in fluidic connection with both first and second conduits such that gas may flow from the first conduit to the second conduit.

In FIG. 3, the end of the first gas conduit extends beyond the end of the second gas conduit at the sampling region of the probe. The teachings of the present invention also include a configuration in which the ends of the two conduits are level and other configurations in which the second gas conduit extends beyond the first gas conduit. Preferably, the distance from the end of the first gas conduit to the end of the second gas conduit, measured in terms of the diameter of the outer conduit at its rim, lies in the range of 0-1 diameters, 1-2 diameters, 2-3 diameters, 3-5 diameters, or 5-10 diameters. Furthermore, manual and automatic mechanisms may be provided to allow easy variation of the relative position of the two conduits for the purpose of optimising performance.

In other embodiments, the first and second gas conduits can have non-uniform cross-sectional profiles. For example, the end of the first gas conduit can be tapered or flared.

It will also be understood that the first and second gas conduits may be provided as channels in a probe module rather than as discrete components. The channels and any associated ports, electrical connections, and electrodes may be formed by drilling, milling, laser machining, 3D printing, wet chemical etching, dry plasma or reactive ion etching, electrochemical or photo-assisted electrochemical etching, ion beam milling, electrical discharge machining, evaporation, thick film deposition, sputtering, electroplating, electroforming, moulding, casting, chemical vapour deposition, epitaxy, embossing, and/or contact printing. The probe module can be configured as an array of individual plasma probes, each comprising first and second gas conduits. In such an embodiment of the invention, the first gas conduits are supplied from a common gas supply manifold and the second gas conduits are connected to a common mass spectrometer inlet. Each probe is provided with electrodes for the purpose of generating a plasma or, alternatively, a single set of electrodes may be used to apply an electric field uniformly across all the probes. It is recognised that in certain circumstances, it is advantageous to provide an array of microbubbles rather than a single bubble with the same total volume, for example, when there are strong lateral drag forces due to liquid crossflow.

The dynamics of bubble attachment to a submerged orifice are partly determined by the contact angles and forces at the interface of the bubble with the rim of the orifice. In this context, it may be advantageous to chemically, mechanically, or structurally modify the rim of the first gas conduit. Such modifications include oxidation, etching, plating, chemical vapour deposition, epitaxy, coating, nanoparticle deposition, grinding, polishing, lapping, flame polishing, and microstructuring.

During operation of the plasma probe, one or both of the gas conduits may be heated. Mild heating of the gas passing through the first conduit and into the bubble may improve the efficiency of analyte desorption from the gas-liquid interface. Heating of the second conduit prevents condensation and cluster formation as gas and entrained ions flow to the mass spectrometer.

In this arrangement, a plasma 305 is provided within the bubble by initiating and maintaining a dielectric barrier discharge, which requires at least one electrode to be separated from the discharge gas 108 by an insulator. This can be achieved by constructing the outer tube 105 from glass or ceramic. To reduce photo-induced modification of the liquid sample by UV light from the plasma, a material that is opaque to UV light is preferred. If the plasma probe 300 and components therein are fabricated using planar processing techniques, then the dielectric barrier may be provided as an oxide layer.

An ac waveform 109 is applied to the collar electrode 107 while the second conduit 103 is grounded and serves as the counter electrode. Above a threshold ac waveform amplitude, the electric field between the powered electrode 107 and the ground electrode 103 is sufficient to initiate and maintain a discharge in the gas 108. Electrical conduction through the liquid may be prevented by encapsulating the electrode 107 and its connecting wire in an insulator or positioning the electrode and/or the probe such that the electrode 107 is not immersed in the liquid. In an alternative embodiment of the present invention, the collar electrode 107 is grounded while the ac waveform 109 is applied to the second conduit 103. If the mass spectrometer 102 incorporates an ion guide, it may be advantageous to derive the ac waveform applied to the second conduit from the ac waveform applied to the ion guide.

The action of the plasma releases and ionises analytes present at the gas-liquid interface defined by the bubble 302. Ions formed in this way become entrained in the gas flow and are consequently drawn into the mass spectrometer 102, where they are analysed.

Desirably, the discharge gas 108 is selected from the group comprising helium, argon, xenon, neon, nitrogen, and air. Mixtures of two or more of these gases may also be advantageous. In particular, the introduction of a small amount of nitrogen into a helium discharge or the afterglow region is likely to promote analyte ionisation through the process described by Horvatic, V.; Vadla, C.; and Franzke, J. in *Spectrochimica Acta Part B,* 100, 2014, 52-61. In this context, the provision of an auxiliary gas source in fluidic connection with the sampling region of the plasma probe may be useful. The present teachings also include doping of the discharge gas 108 with other chemical additives that reduce the ignition voltage, alter the plasma chemistry, and/or promote analyte ionisation.

While FIG. 3 shows the plasma probe 300 inverted and passing vertically through the free surface of a liquid in a beaker, it will be understood that the probe and the attached bubble may be presented at any orientation. This may require the provision of a port making a seal with the probe. Furthermore, the liquid to be analysed may be flowing through a pipe or contained within an enclosed vessel, a liquid reservoir.

The rate of gas flow through the first conduit 105 must equal the rate of gas flow through the second conduit 103 when a single bubble 302 of stable dimensions remains attached to the open end of the first conduit 105. Hence, the gas flow 108 may not be freely adjusted. If the gas flow rate is too high, a stream of bubbles will issue from the open end of the first conduit and the signal will be intermittent. If the gas flow rate is too low, liquid will be drawn into the second conduit and thereafter the mass spectrometer 102, where it may cause damage. An inline solenoid valve can be provided to isolate the mass spectrometer 102 in the event that rising liquid is detected in the second conduit 103.

The maximum acceptable gas flow rate for the arrangement in FIG. 3 is dictated by the pumping capacity and operating pressure of the mass spectrometer 102. Hence, the conductance of the second gas conduit, which is determined by its length and cross-sectional profile, should be selected in accordance with the maximum expected bubble pressure. Further considerations relating to the geometry of the second gas conduit include the distance between the plasma probe and the mass spectrometer; control of the flow Reynolds number such that laminar flow conditions prevail; and ion loss mechanisms. Ideally, the gas flow through the second gas conduit should also be matched with the optimum flow rate for plasma operation and ejection of the plasma into the bubble. These operational and geometrical constraints may be eased or reconciled by providing a flow split prior to the mass spectrometer 102 that diverts a fraction of the gas load. A draw-through pump may provide further flexibility.

Analysis of the physical processes involved in bubble growth and detachment is highly complex. An overview is given by Simmons, J. A.; Sprittles, J. E.; and Shikhmurzaev, Y. D. in *European Journal of Mechanics B* 53, 2015, 24-36. The forces acting on a bubble attached to the open end of a tube submerged in a stationary or moving liquid include the internal gas pressure, surface tension, hydrostatic pressure, baric pressure, buoyancy, hydrodynamic lift and drag, and contact forces. At the early stages of bubble formation, a hemispherical dome grows from the submerged orifice. As inflation continues, the minimum surface energy is achieved by a spherical bubble attached by a neck to the orifice rim. Buoyancy forces increase with the bubble volume and eventually a free bubble breaks off, leaving a smaller bubble attached to the orifice. The inverted arrangement shown in FIG. 3 is somewhat more complex because the buoyancy force is opposed by the tube 105, which applies an equal and opposite reaction force. Consequently, the bubbles distort into a more oblate form.

Bubble streaming from a submerged source is classified as static, dynamic or turbulent. The static regime prevails at low flow rates and is identifiable by a bubble size that is fixed at a minimum value. As the flow rate is increased, the bubble size remains constant while the bubble formation time decreases. Eventually, the formation time reaches a limiting minimum value and any further increase in the flow rate is accommodated by an increase in bubble size. At high flow rates, bubble formation becomes turbulent. Successive bubbles coalesce chaotically at the orifice to form a gas envelope that breaks up into many small bubbles. A stable, attached bubble is essentially a limiting case of the static regime in which inflation has been arrested before a free bubble is pinched off at the neck.

While a stable, attached bubble is preferred, in some circumstances, continuous bubble streaming in the static or dynamic modes may be advantageous. For example, if an ion trap mass spectrometer is employed, the trap filling and ejection cycles may be synchronised with the periodic bursts of ions generated by momentarily attached bubbles. The overall exposure of the liquid to the plasma is reduced, compared with the stable bubble mode, which minimises any alteration of the liquid phase chemistry by the plasma probe. Alternatively, the size of an attached bubble may be modulated by small pulsations of the applied pressure, allowing phase sensitive detection of the ion signal. As ionisation at the gas-liquid interface is expected to respond to variations in the bubble size, such pulsations may also facilitate discrimination of analyte ions from background plasma species.

An investigation of plasmas discharges in bubbles in the context of water treatment applications has previously been reported by Foster, J.; Sommers, B.; Weatherford, B.; Yee, B.; and Gupta, M. in *Plasma Sources Sci. Technol.* 20, 2011, 034018. FIG. 2 of this publication shows gas escaping from a submerged tube in the turbulent mode; bubbles have coalesced to form an unsteady envelope around the end of the tube. An arc extends from the central powered electrode and terminates at the air-water interface.

In some cases, it may be advantageous to add chemical modifiers to the liquid being analysed. For example, the addition of surfactants, polymers, lipids, or certain proteins may modify the gas-liquid interface of the bubble such that desorption is more facile or selective, while the addition of buffering agents or redox reagents may limit the effects of reactive plasma species.

A person of skill in the art will appreciate that the mass spectrometer 102 may be configured as a quadrupole, timeof-flight, magnetic sector, or an ion trap mass spectrometer, and that any such instrument may also be provided in a hybrid and/or tandem configuration. The mass spectrometer may also be provided in a miniature, portable, and/or compact format. It will be understood that on exiting the second conduit 103, ions may pass through one or more stages of differential pumping prior to mass analysis, and that each stage may contain an ion guide. It will further be appreciated that on exiting the second conduit 103, ions may be filtered by ion mobility spectrometry.

Figure 4:
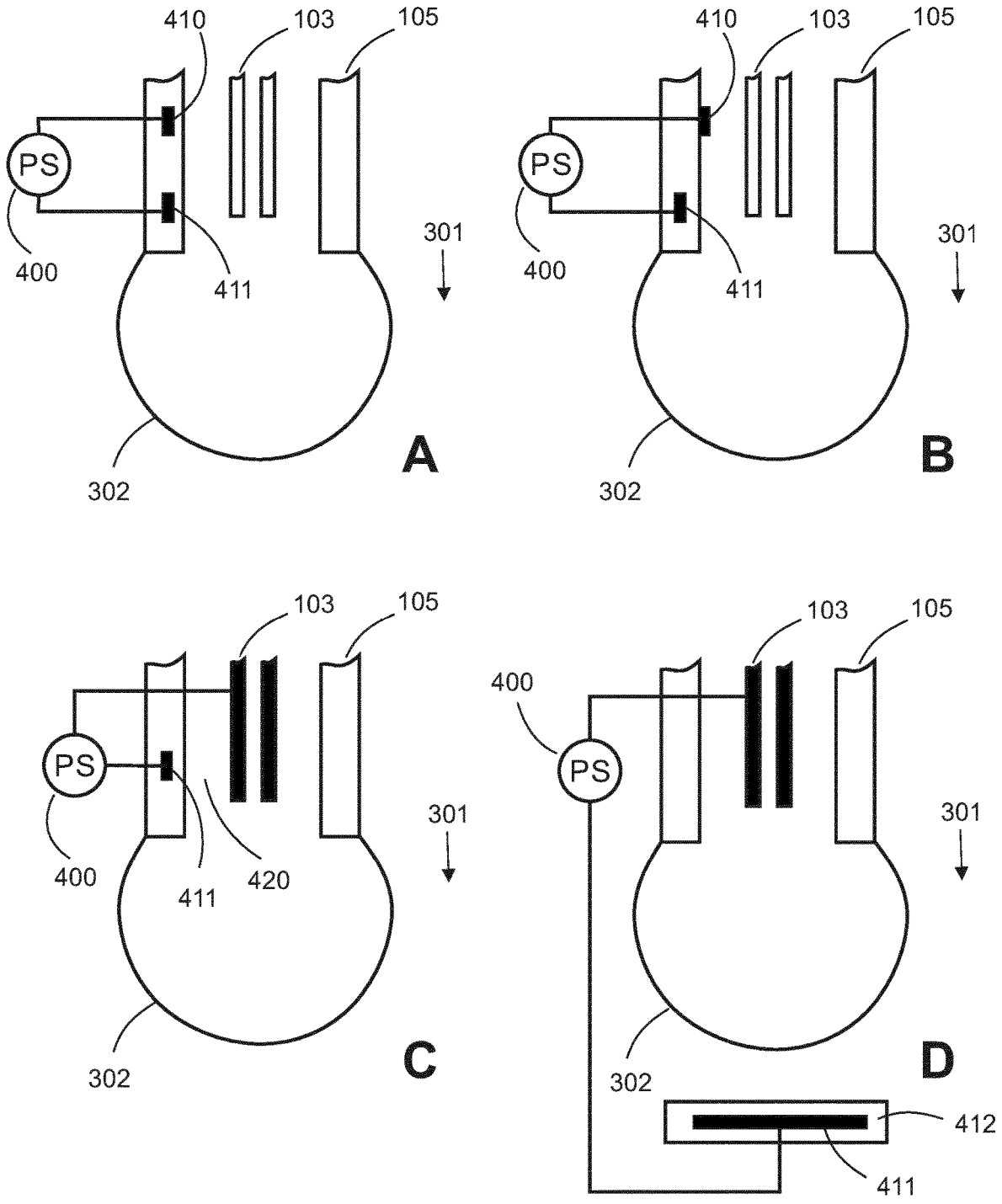
FIG. 4 shows alternative electrode configurations that may be used to develop a dielectric barrier discharge.

FIG. 4 shows various alternative electrode configurations that may be used to generate a dielectric barrier discharge. It will be understood that these arrangements are exemplary and that the teachings of the invention also include functionally equivalent configurations. In each case, the power supply 400 may be configured to supply an ac or a pulsed direct current (dc) waveform. A person of skill in the art will appreciate that additional dc biasing and connections to electrical earth can be included without departing from the spirit of the invention. Furthermore, the relative positions and biasing of the plasma generator electrodes 410, 411 may be varied such that the electric field either propels the plasma out of the probe or has no influence on the position of the plasma. One or more additional grid electrodes carrying dc bias potentials may also be provided to modify the electric field in the probe. For example, grid electrodes provided downstream of the discharge may be used to prevent transport of ions and/or electrons out of the probe but allow free movement of metastable species such as metastable helium. Alternatively, the additional electrodes may be configured to expel ions or electrons from the probe.

In FIGS. 4A and B, the conductors that form the electrode arrangement 410, 411 generate a surface dielectric barrier discharge within the arrangement of coaxial tubes 103, 105. Preferably, in this exemplary configuration, both electrodes 410, 411 are configured as ring or collar electrodes so that the discharge is uniformly distributed. The second gas conduit 103 is not part of the plasma generator and may be fabricated from a dielectric material. A volume dielectric discharge is created in the gap 420 between the coaxial tubes 103, 105 by the electrode arrangement in FIG. 4C. At least a part of the second gas conduit 103 is conducting and serves as one of the electrodes. Again, the outer electrode 411 is preferably provided as a ring or collar. The schematics in FIG. 4 represent the portion of the probe that is immersed within the liquid 301 that is being sampled.

In all previously discussed embodiments, the discharge occurs within the arrangement of coaxial tubes and the plasma is ejected into the bubble by the applied electric field and/or the flow of gas. However, in FIG. 4D, the electrodes are arranged to promote a discharge and plasma formation within the bubble. Specifically, in this arrangement, the second electrode 411 is provided separate to the probe and a dielectric barrier 412 is provided between the second electrode 411 and the bubble 302. The electric field between the second gas conduit 103, at least a part of which is part conducting, and the second electrode 411 initiates and maintains a plasma within the bubble, in a similar fashion to that described previously.

Figure 5:
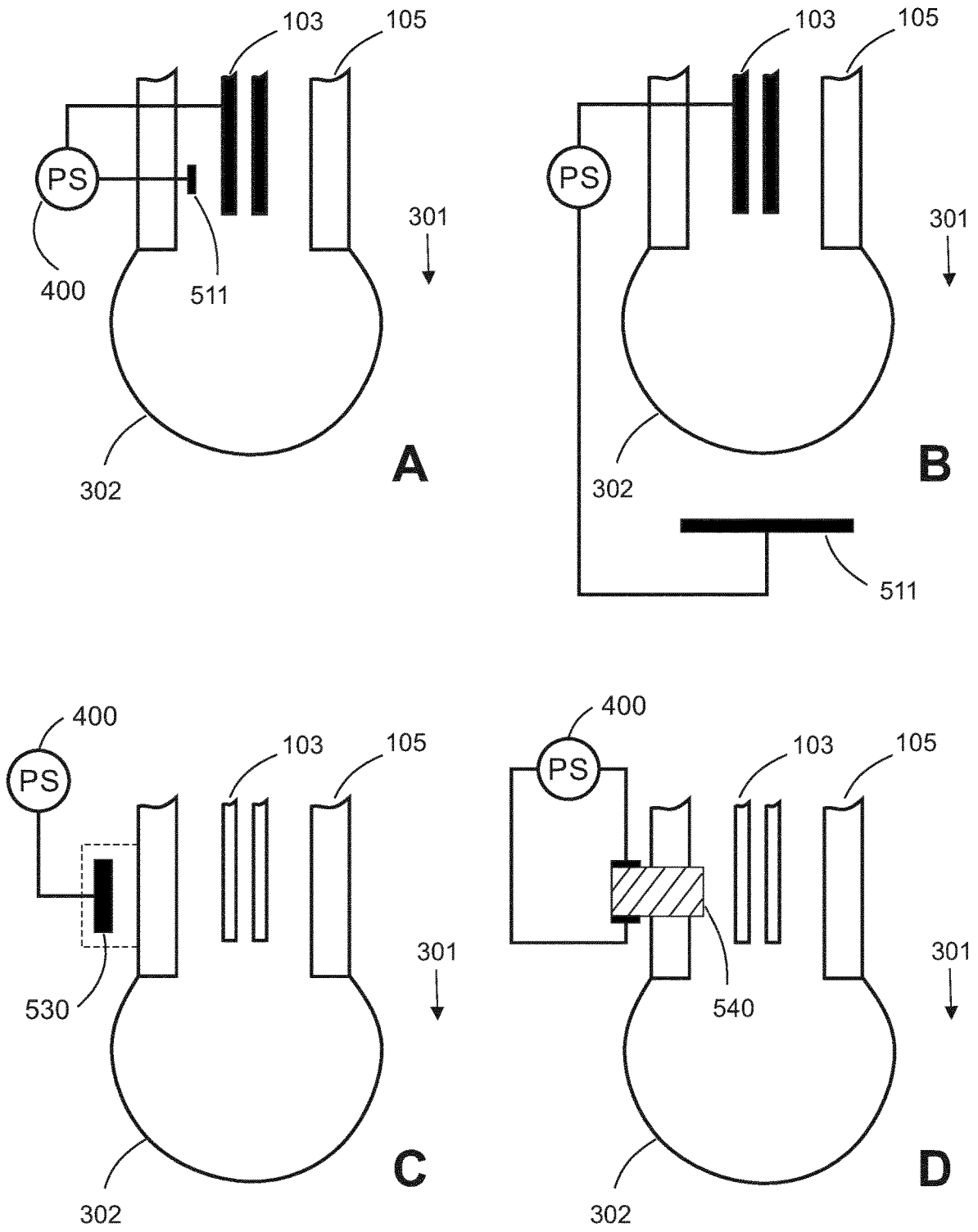
FIG. 5 shows further electrode configurations that may be used to establish a discharge.

In FIG. 5, which again shows a portion of the probe as immersed into the liquid sample 301 under test, alternative means of generating a plasma that do not involve a dielectric barrier discharge are presented. The arrangement in FIG. 5A allows a direct discharge between the second gas conduit 103, at least a part of which is conducting, and a second electrode 511 located within the region between the gas conduits. Depending on the current, which may be controlled with a ballast resistor, the discharge is identified as a dark, corona, glow, or arc discharge. Presenting the outer electrode 511 as a sharp tip rather than a plate enhances the field strength. A direct discharge is also promoted by the electrode configuration shown in FIG. 5B where at least a part of the second gas conduit 103 is conducting and serves as a first electrode, and a second electrode 511 is provided within the bulk liquid 301. However, in this case, the liquid 301 has some electrical conductivity and forms part of the electrical circuit, allowing the discharge to terminate at the gas-liquid interface. In FIG. 5C, the plasma is generated by microwave excitation. A microwave generator comprising a power source 400 coupled to an antenna 530 is provided. The microwave radiation is coupled into the cavity between the coaxial tubes by the external antenna. Finally, in FIG. 5D, a plasma is generated by a piezoelectric transformer 540 excited by a low voltage ac waveform.

It will be appreciated that in other configurations, such as those that will be described below relating to an acoustic generator, the piezoelectric element of FIG. 5D could be configured to effect creation of acoustic waves to cause a pulsation of the formed bubble as opposed to the arrangement of FIG. 5D where it is configured to generate a plasma. In such an arrangement, the plasma could be formed by one of the other types of plasma generation herein described.

Figure 6:
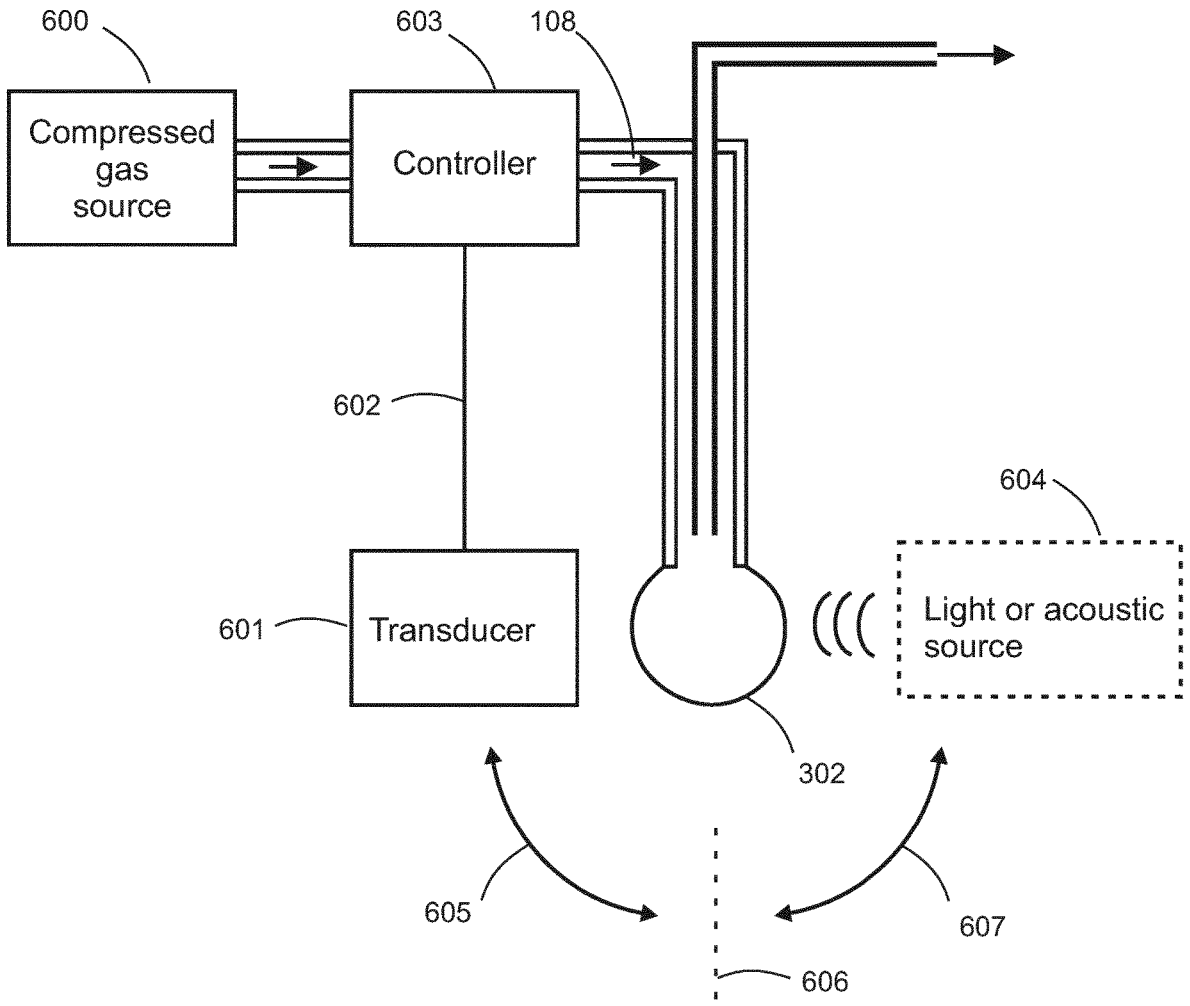
FIG. 6 shows a feedback loop provided to control the size of a gas bubble attached to the co-axial arrangement of gas conduits.

FIG. 6 shows a schematic representation of a control system provided in accordance with the present invention. The purpose of the control system is to maintain a stable, attached bubble by dynamically varying the gas flow rate or applied gas pressure. If, for example, the sampling region of the probe is moved to a deeper position within a volume of liquid, then the gas pressure in the bubble must be increased to compensate for the greater hydrostatic pressure. Bubble control is achieved using a feedback loop or circuit comprising a transducer and a gas control module. The transducer 601 provides an electrical signal 602 that is related to the size of the bubble 302 and the control module 603 varies the gas pressure or flow rate according to an algorithm. The control module 603 comprises a pressure regulator, a metering valve, a proportional valve, and/or a mass flow controller. In a preferred embodiment, the algorithm is setup and optimised automatically during a machine learning phase in which the bubble inflation characteristics are monitored as the gas flow rate or pressure is varied. In an alternative embodiment the control module also optimises the setup of the plasma power supply by varying the voltage or frequency, for example, based on measurements of the current, absorbed power, and/or plasma temperature. In a second alternative embodiment, data recorded by the mass spectrometer is supplied to the control module, which optimises a figure-of-merit, such as the absolute signal intensity, the signal-to-noise ratio, or the signal stability, by varying the plasma conditions and bubble size. In general, it may be useful to control and optimise aspects of bubble inflation and plasma operation using artificial intelligence algorithms.

A transducer at a fixed position may employ capacitance or inductance measurements to determine the proximity of the gas-liquid interface and hence, the size of the bubble. Miniature proximity detectors employing capacitance or inductance measurements are widely available.

In an alternative embodiment, an external source of light or acoustic radiation 604 is also provided. When the source is configured as a light source, the size of the bubble is determined by monitoring the refraction or reflection of the light at the gas-liquid interface using the transducer 601. In effect, the gas-liquid interface is acting as a lens or mirror whose focal length depends on the radius of the bubble. It may be advantageous to operate the light source and transducer at a wavelength corresponding to low plasma luminosity. The transducer 601 may be oriented at a variable angle 605 with respect to an axis 606 and similarly, the source 604 may be independently oriented at a variable angle 607 with respect to the same axis 606. When the light source 604 is positioned in line with the transducer 601 i.e. the sum of the angles 605 and 607 is about 180°, then the attenuation of the transmitted light intensity, compared with no bubble present, provides a measure of the bubble size.

If the source 604 is configured as an acoustic source, the size of the bubble may similarly be determined by monitoring the absorption, scattering, or reflection of sound using the transducer 601. However, it is also recognised here that acoustic pressure fields cause bubbles to pulsate. When the acoustic frequency matches the natural resonance frequency of the bubble, which is related to its radius, absorption and scattering are significantly enhanced. Hence, the bubble size may alternatively be stabilised by servoing the gas pressure so as to maintain the resonance at a fixed frequency.

The inventors have also realised that there are further benefits of exposing an attached bubble to sound. As described by Hashmi, A; Yu, G; Reilley-Collette, M; Heiman, G; and Xu, J. in *Lab on a Chip,* 12, 2012, 4216-4227, the bubble pulsations caused by an acoustic pressure field result in a liquid flow pattern known as microstreaming and a secondary radiation field known as the Bjerknes force, which acts on particles. To date there has been no realisation or understanding that this effect can be usefully employed in the context of sample analysis for mass spectrometry.

The present inventors have identified that the strong velocity gradients associated with microstreaming result in efficient mixing of the liquid surrounding the bubble. However, in the absence of any bulk flow, the plasma probe will steadily deplete the liquid surrounding the bubble of analyte and at the same time increase the local concentration of plasma-induced reaction products, resulting in mass spectra that may not be representative of the liquid as a whole. Hence, an embodiment of the invention provided with an acoustic source that induces microstreaming will benefit from a continuous refreshing of the analyte concentration in the vicinity of the bubble and dispersal of the reaction products. In effect, the acoustically-driven bubble pulsations cause an agitation and subsequent mixing of a liquid within the liquid reservoir and ensure that the liquid proximate to the bubble surface is being refreshed. This approach will be appreciated as being more convenient than using a mechanical agitator such as a stirrer or the like. It will also be understood that moving the probe, and subsequently the bubble extending from the probe, may allow for a change in the sampling region but does not necessarily effect a pulsation of the bubble which provides the advantages outlined above.

Another benefit of acoustically-driven bubble pulsations relates to the behavior of particles under the combined influence of the microstreaming flow field and the Bjerknes force. The Bjerknes is directed towards the bubble if the particle is more dense than the liquid. Above a threshold acoustic amplitude, the Bjerknes force is greater than the drag due to microstreaming and consequently, particles stick to the bubble. This effect may be exploited to analyse particulates using the plasma probe; in the presence of an acoustic pressure field, particles adhered to the bubble may be analysed through the action of the plasma. In many chemical reactions, reaction products precipitate from the solution. Hence, the ability to analyse the particulate products as well as reactants in solution allows comprehensive profiling of the reaction. Furthermore, in biochemical applications, cellular components may be analysed by using acoustic activation to trap cells at the bubble surface.

Figure 7:
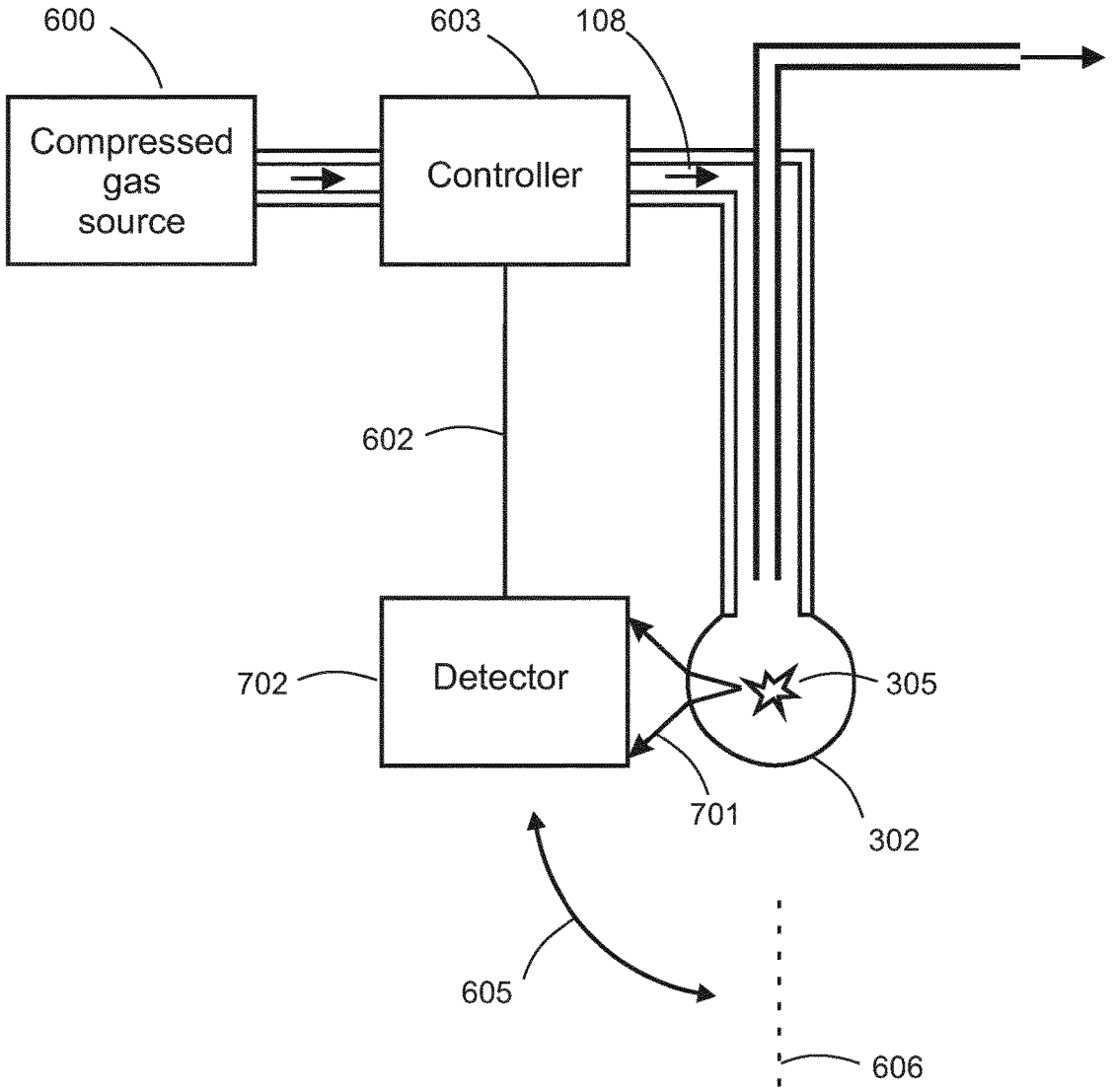
FIG. 7 shows an alternative feedback loop configuration in which refraction of light from the plasma is used to determine the size of the bubble.

FIG. 7 shows a further embodiment of the invention in which the light 701 emitted by the plasma 305 is refracted at the gas-liquid interface, which acts as a diverging lens. Any variation in the size of the bubble 302 changes the curvature of the gas-liquid interface and hence, the divergence of the emitted light rays, which is monitored by a detector 702. If the detector 702 is configured as an imaging detector, a one-dimensional line-scan or a two-dimensional array of pixels is communicated to the control module 603 via a link 602. Software or firmware hosted by the control module 603 interprets the intensity data and adjusts the applied gas pressure accordingly. The system may be configured such that light is transmitted to the detector 702 by an optical fibre or optical fibre bundle. Furthermore, the plasma conditions may be monitored and optimised if the detector 702 is configured as an optical emission spectrometer. For example, the bubble size, gas flow rate, power supply characteristics and/or gas composition may be varied to maximise the intensity of an optical transition arising from a reactive species such as $N_2^+$.

Figure 8:
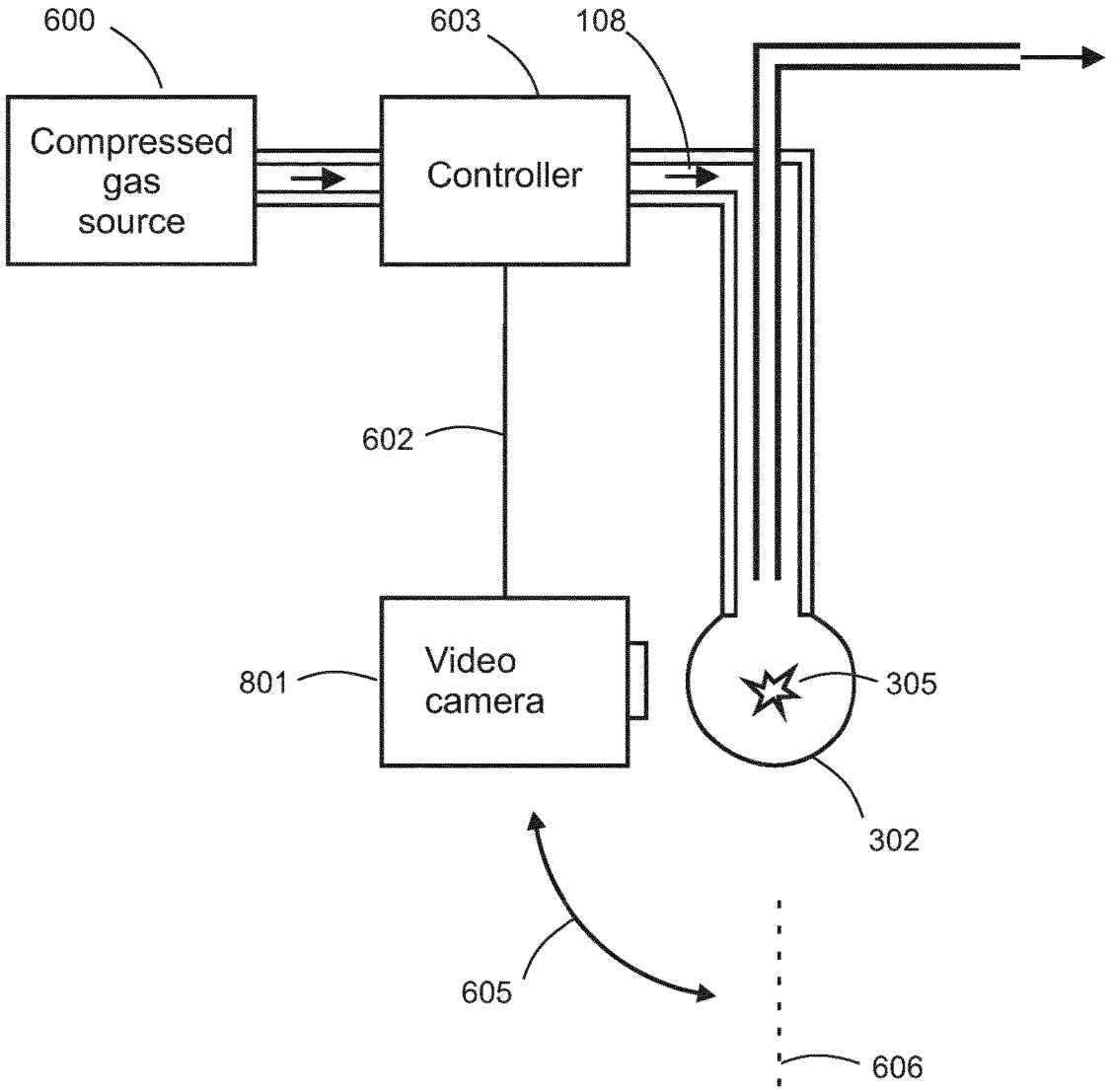
FIG. 8 shows an alternative feedback loop configuration in which a video camera is used to determine the size of the bubble.

FIG. 8 shows a further embodiment of the invention in which the bubble is directly imaged using a video camera 801. A video signal is communicated to the control module 603 via a link 602. Software or firmware hosted by the control module 603 determines the position of the gas-liquid interface and adjusts the gas flow rate or applied pressure accordingly. Software utilities such as the Matlab™ Canny edge detection function may be used to automatically determine the bubble perimeter from a video image. If sufficient ambient illumination is available, the bubble can be stabilised before initiating the plasma. Once the plasma is initiated, the video image can additionally be employed to monitor plasma properties such as stability or the spatial distribution.

Figure 9:
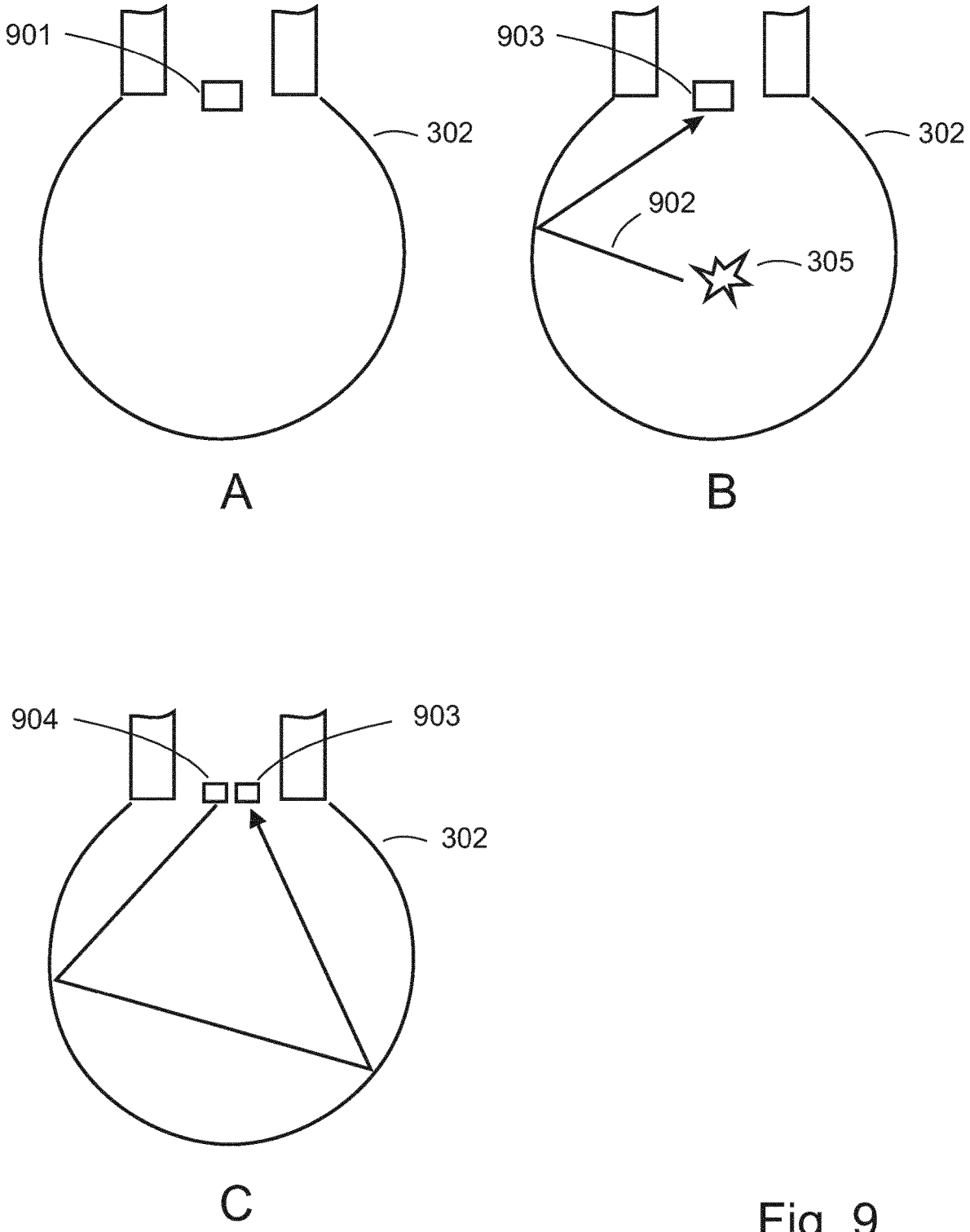
FIG. 9 shows systems for monitoring the bubble size in which the monitoring mechanisms are integrated with the probe.

FIG. 9 shows schematic representations of further advantageous embodiments of the invention in which the plasma probe is provided as a single integrated system. The systems shown in FIGS. 6-8 all require additional external modules to implement the control mechanism. For clarity, some previously described elements have been omitted. In FIG. 9A, a miniature pressure sensor 901 is positioned in the gas flow path and close to or inside the bubble. An electrical signal proportional to the pressure is provided to the control module, which varies the flow rate according to an algorithm. In FIG. 9B, light rays 902 emitted by the plasma 305 are internally reflected at the gas-liquid interface defining the bubble 302 and are focused on a detection module 903 following one or more such reflections. Reflection occurs because of the difference in refractive indices of the gas and liquid. The detection module 903 may be configured as a photodiode or other light sensitive detector, a camera, or an optical fibre coupled via suitable optics to a remote detector or camera. The signal or image is interpreted by the control module, which varies the applied gas pressure or flow rate accordingly. In FIG. 9C, an independent internal source of light or sound 904 is also provided. As in FIG. 9B, the emitted light or acoustic radiation undergoes internal reflections at the bubble boundary such that it may be detected by the detector module 903.

The foregoing discussion has assumed a bubble inflation process that begins with a hemispherical dome emerging from the submerged orifice and progresses to a near spherical bubble attached via a neck, which eventually pinches off. However, in the presence of liquid crossflow, shear forces act on the bubble causing shape distortion and tilting of the longitudinal axis. Particular combinations of geometry, material properties, and flow rate may also result in side-to-side oscillations of an attached bubble. In this context, measurement of the tilt angle or oscillation frequency using any of the techniques discussed in connection with FIGS. 6-9 may be used in combination with the feedback loop to arrest the inflation process such that the bubble remains attached. Alternatively, the effects of crossflow may be minimised by reducing the size of the submerged orifice and in consequence, the size of the attached bubble. This has the effect of reducing the relative importance of shear compared with other forces acting on the bubble. Depending on the flow rate, orifice diameters of 5-10 mm, 1-5 mm, 0.5-1 mm, 0.1-0.5 mm, or less than 0.1 mm may be advantageous.

While the control systems described in connection with FIGS. 6-9 are preferably configured to arrest and stabilise bubble inflation such that the bubble remains attached, continuous bubble streaming may be advantageous in some circumstances, as previously described. When this is the case, the control system may be configured to control the bubble formation rate (static bubbling mode) or the bubble size at detachment (dynamic bubbling mode). For example, the bubble formation rate can be determined from the periodic transducer signal variations arising from bubble inflation and detachment.

Figure 10:
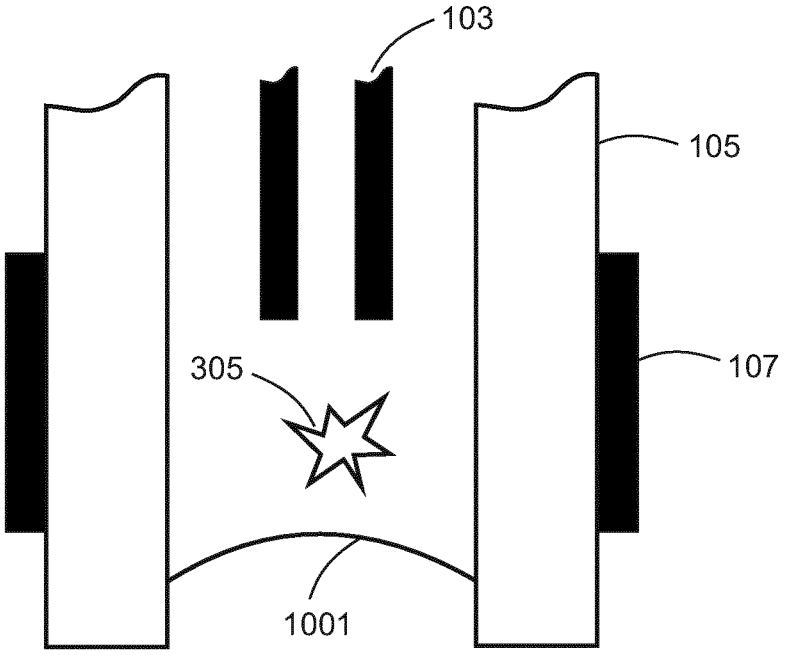
FIG. 10 shows a second embodiment of the invention in which liquid is drawn up into the plasma probe.

FIG. 10 shows a modification of the mode of operation, which may be applied to the previously described systems. Here, a bubble does not extend from the first conduit 105. Instead, the applied gas pressure is adjusted such that the liquid rises up into the first conduit, where it is bounded by a curved meniscus 1001. A plasma 305 is formed in the void between the meniscus and the second conduit 103. As before, the plasma causes release and ionisation of analytes present at the gas-liquid interface, and the resulting ions are drawn into the second conduit 103. A disadvantage of this configuration is that the volume of liquid drawn up into the first conduit 105 is essentially stagnant and its composition may not be representative. This problem can be alleviated by modulating the applied gas pressure such that periodically, the stagnant volume is discharged and fresh material is drawn in.

Figure 11:
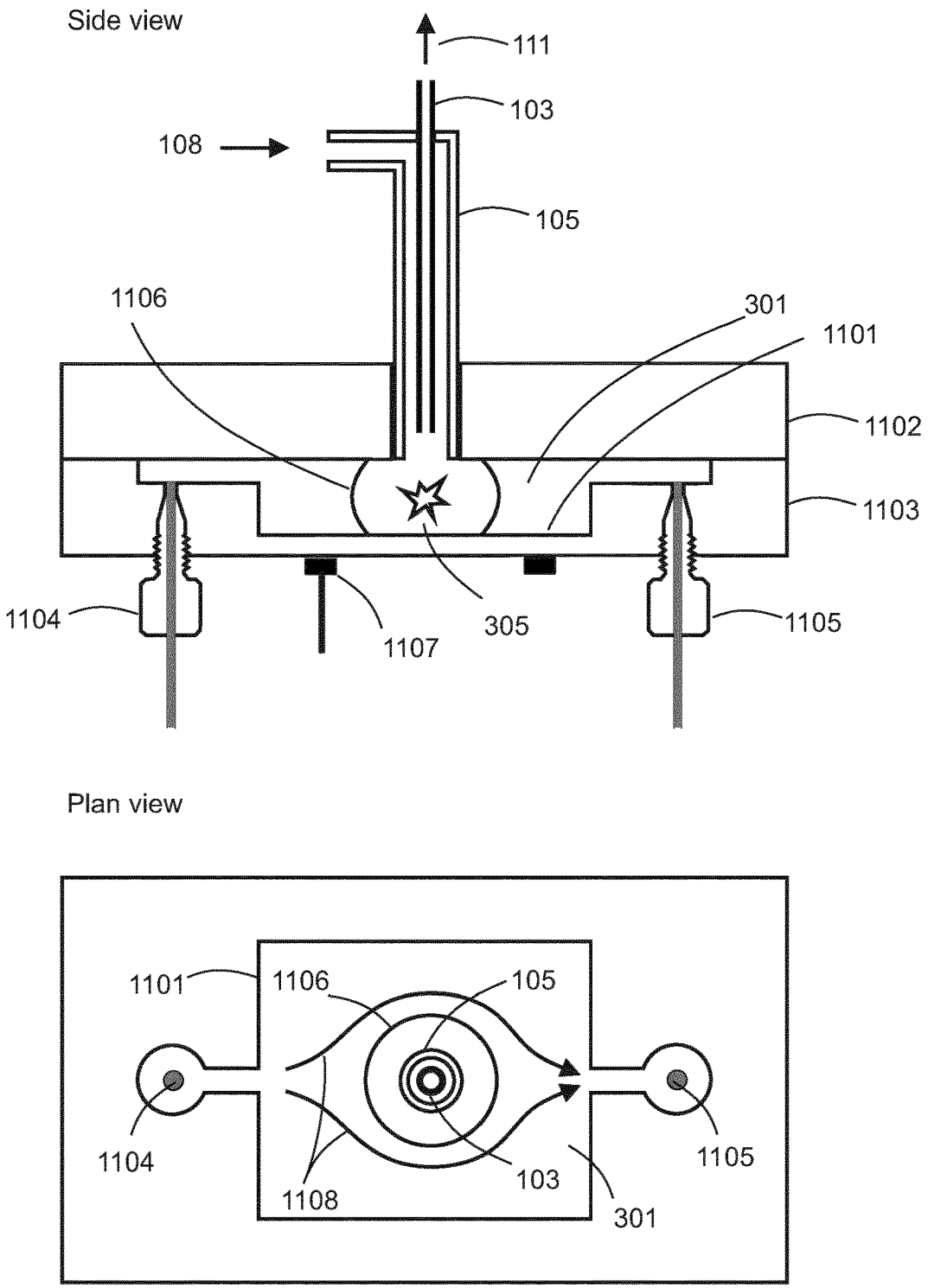
FIG. 11 shows third embodiment of the invention configured as a plasma ionisation flow cell for monitoring analytes in a continuous liquid stream.

FIG. 11 shows a schematic representation of a flow cell provided in accordance with the present teaching. The flow cell allows the plasma probe to be coupled to the outflow from a chromatography system without introducing a significant dead volume. Alternatively, it may be integrated into micro total analysis, lab-on-a-chip, and other microfluidic systems. A shallow cylindrical or rectangular cavity 1101 is defined by an upper block 1102 and a lower block 1103. The blocks are preferably fabricated from an inert dielectric material such as glass, acrylic, polycarbonate, PEEK, or PTFE. A liquid stream flows into the cavity through a first port 1104 and out of the cavity through a second port 1105. The plasma probe is inserted through a hole in the upper block 1102 with which it makes a tight seal. A stable bubble is formed in the liquid by controlling the applied gas pressure or flow rate as described previously. The longitudinal dimension of the barrel-shaped bubble is constrained by the lower block 1103 but the radial gas-liquid boundary 1106 is free to move in response to the applied pressure. As the radius of the bubble increases, the flow cell dead-volume decreases. When the end of the first gas conduit is presented as an orifice in a block rather than a tube, the bubble contact line is not necessarily pinned to the orifice rim and may freely move across the surface of the block. It may be useful in this context to control the propensity for contact line detachment from the orifice rim by varying the surface wettability through choice of material or chemical modification.

In this exemplary embodiment, a dielectric barrier discharge generates a plasma in the bubble when an ac waveform is applied to an external ring electrode 1107. The plasma probe serves as the ground electrode. However, other electrode configurations such as those discussed in connection with FIGS. 3-5 may also be used. The streamlines 1108 of the flowing liquid 301 pass over the bubble boundary. Consequently, plasma interactions with the gas-liquid interface allow dissolved analytes to be released and ionised.

Figure 12:
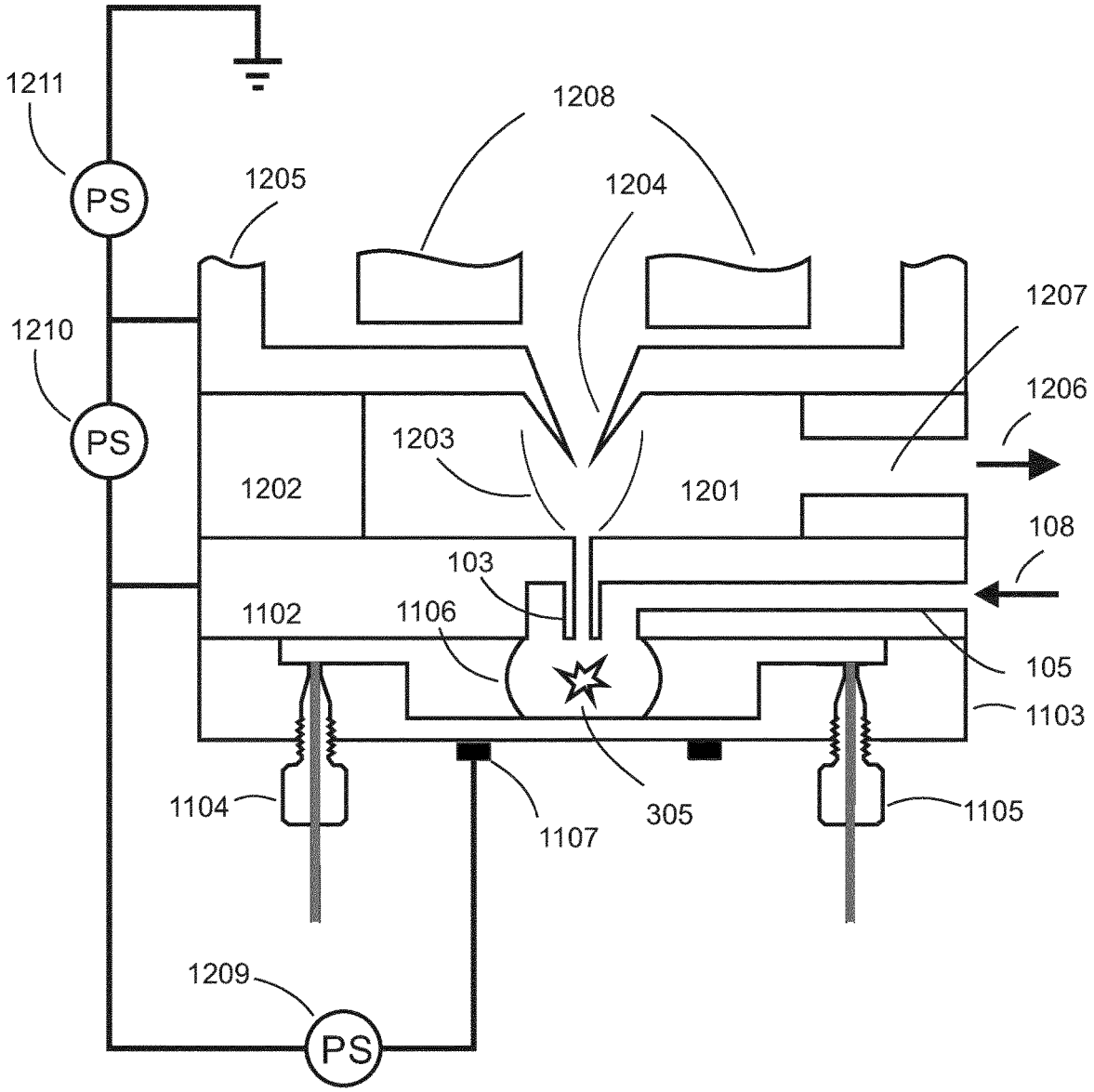
FIG. 12 shows a flow cell integrated with the vacuum interface of the mass spectrometer.

FIG. 12 shows a system in which the flow cell and the vacuum interface of the mass spectrometer are integrated. The advantage of this arrangement is that ion losses in the second gas conduit 103 are reduced as a result of its very short length. Additionally, the pipe fittings needed to couple the flow cell to the mass spectrometer in FIG. 11 have been eliminated.

Operably, gas flows into the cell through the first gas conduit 105, which in this instance has been configured as a channel terminating in a cylindrical well that surrounds the second gas conduit 103. In an alternative arrangement, further gas inlet channels, each connected to a common external manifold, are symmetrically disposed around the central well such that the flow is supplied evenly. As above, a plasma 305 is provided in a bubble defined by a gas-liquid interface 1106. Analyte ions become entrained in the gas flow that passes through the second gas conduit 103, which is also configured as a channel in the intermediate block 1102. The second gas conduit 103 leads directly to a vacuum chamber 1201 defined by a cavity in a spacer block 1202. The gas expands as a free jet expansion 1203, which is intercepted by a skimmer cone 1204 mounted on the second stage vacuum bulkhead 1205. A portion of the gas and entrained ions is transmitted to the second stage while the remainder 1206 is pumped from the vacuum chamber 1201 through at least one channel 1207. Additional pumping channels may be provided to improve the pumping speed. Transmitted ions are captured by a radio-frequency quadrupole 1208 and subsequently mass analysed. A person of skill in the art will appreciate that other types of vacuum interface are known, including stacked-electrode ion funnels and off-axis extraction cones, and that these may be used instead of a skimmer-based interface without departing from the teachings of the invention.

Power supplies 1209-1211 apply dc and ac voltages to the external ring electrode 1107, the second gas conduit 103, and the skimmer 1204. In a preferred configuration, an ac waveform is applied to the ring electrode 1107 by power supply 1209 while other power supplies of the system 1210, 1211 apply dc bias voltages such that ions exiting the channel 103 are accelerated towards the skimmer 1204. Electrical isolation is achieved by providing insulating layers between components of the system and/or fabricating the blocks 1103 and 1202 from an insulating material. A person of skill in the art will appreciate that other arrangements of ac and dc power supplies may be useful.

Figure 13:
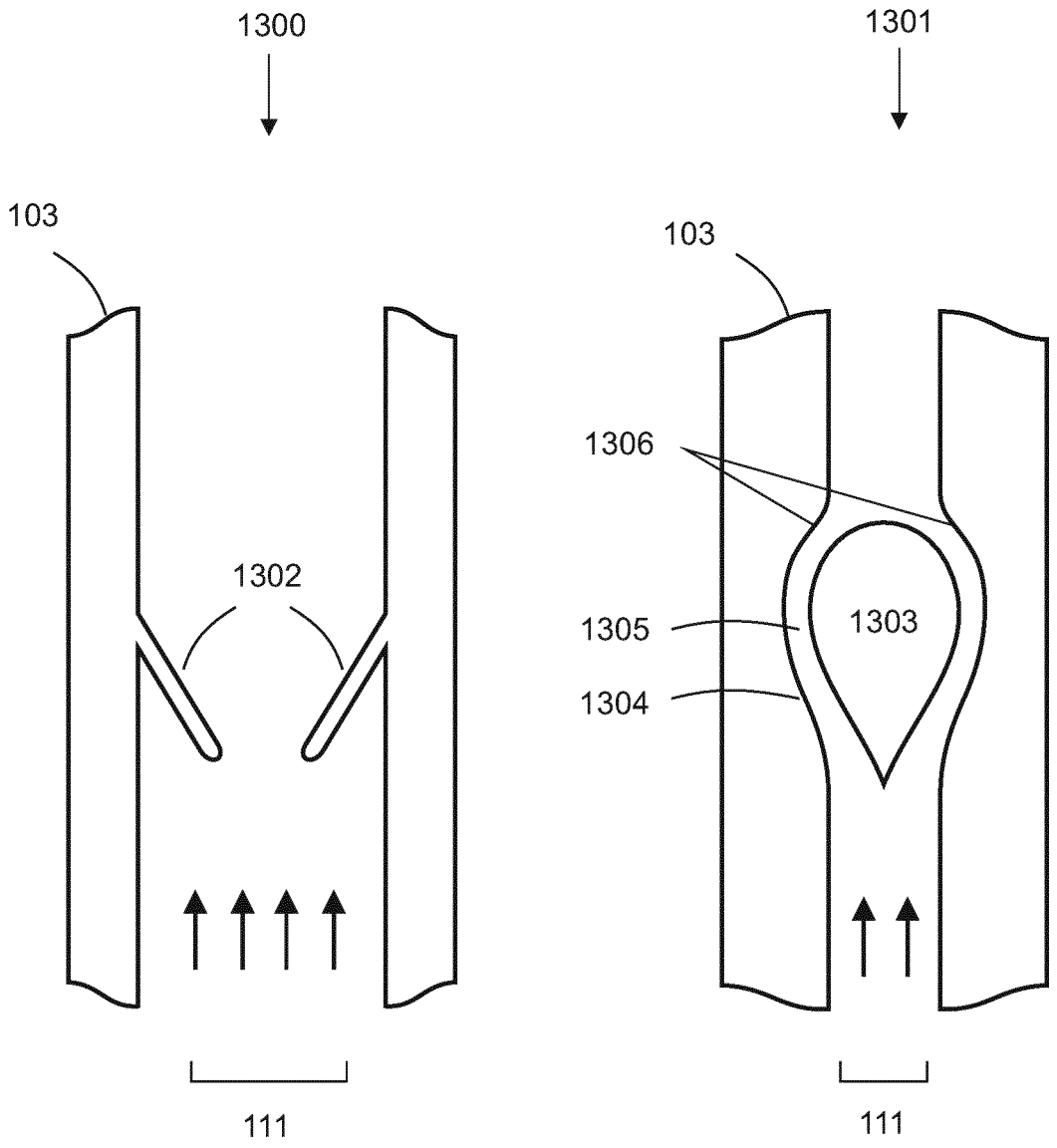
FIG. 13 shows two examples of self-activating valves that prevent liquid being drawn into the mass spectrometer.

FIG. 13 shows two examples 1300, 1301 of self-actuating shut-off valves provided as fail-safe mechanisms to prevent liquid being drawn into the mass spectrometer. During normal operation, the gas bubble and associated control mechanisms prevent the inflow of liquid. However, desirably, a valve is provided to shut-off the mass spectrometer inlet capillary in the event that the gas supply or the control system fails. In the first embodiment 1300, a valve comprising two flexible vanes 1302 is provided within the mass spectrometer inlet capillary 103. When gas 111 is flowing through the capillary tube 103, the drag forces are insufficient to significantly deflect the vanes 1302. However, if liquid is drawn into the second conduit 103, the much greater forces exerted by the flowing liquid deflect the vanes 1302 such that they meet at the centerline and form a seal. A disadvantage of this arrangement is that the vanes are likely to cause significant turbulence during normal operation, which may reduce the ion transport efficiency. However, smooth, laminar gas flow is maintained in the second embodiment 1301, which comprises a stopper 1303 and a contoured cavity 1304 provided within the second conduit 103. The stopper 1303 is able to move freely within the cavity but may optionally be weakly tethered at a central location. It may be spherical, cylindrical, or have a tear-drop profile. During normal operation, gas flows though the channel 1305 between the stopper and the contoured cavity. However, if liquid is drawn into the capillary, the stopper 1303 is forced against the valve seat 1306 forming a tight seal. Given the likely dimensions of a mass spectrometer inlet capillary, it will be appreciated by someone of skill in the art that the shut-off valve is desirably fabricated using micro-engineering techniques. In the event that the shut-off valve is activated by an inflow of liquid, a mechanism is desirably provided to force the liquid out and re-establish an attached bubble. Such a mechanism may involve temporarily pressurising the second gas conduit upstream of the shut-off valve with gas.

Some applications of the present invention are described below. These examples are illustrative and are not intended to limit the scope of the invention or its uses.

(1) When configured as a flow cell, the invention may be used as a detector for a liquid chromatography system. Liquid chromatography includes analytical, preparative, and flash chromatography. The plasma probe provides a means of ionising non-polar molecules that are not readily detected by ESI-MS. This is particularly important when flash or preparative chromatography is used during the early stages of a chemical synthesis, as early intermediates tend to have relatively little chemical functionality.

In preparative and flash chromatography, the column outflow may be diverted by a divertor valve to a collection vessel when a desired product is detected. In conventional systems, the valve trigger signal may be provided by a mass spectrometer coupled to the outflow. However, if ESI-MS is employed, there is a time delay associated with the relatively slow transit of liquid through tubing from the sampling point to the ESI source. Consequently, the outflow is passed through a long coil prior to the divertor valve to allow time for the analysis. This leads to peak broadening and possible re-mixing of previously separated components. The plasma probe flow cell may provide a significantly quicker response time and obviate the need for a delay coil as the flow of gas phase ions through tubing is expected to be much faster than the flow of liquid.

(2) In pharmokinetics there is a need to monitor the concentration of drugs and their metabolites in blood. By applying microengineering techniques, the plasma probe described in the present teachings may be fabricated with millimeter or sub-millimeter dimensions and configured as a cannula. Intravenous or intra-arterial cannulation using a miniature plasma probe may provide real-time, continuous monitoring during mammalian pharmokinetic studies. Alternatively, blood may be removed from a blood vessel using a conventional cannular and passed through a plasma probe flow cell as described in the present teachings, before being returned via a second cannula. More generally, the same plasma probe configurations may be used to monitor patient blood chemistry in applications including critical care, anesthesia, disease diagnosis, and emergency medicine.

(3) Water quality monitoring protects the environment and consumers from chemical contamination. Such contamination may arise from accidental discharges from industrial plant or from malicious acts. Plasma probe ionisation as described in the present teachings is ideally suited to spot checks or continuous monitoring of rivers, lakes, and potable water supplies, particularly when coupled to a miniature mass spectrometer such as that in co-assigned patent U.S. Pat. No. 8,796,616B2.

(4) Industrial processes often involve liquids flowing in pipes or batchwise processing of liquids held in vats. The liquid may be under pressure and at an elevated temperature. Conditions often change rapidly, particularly during a system failure or runaway reaction. Chemical concentrations may be spatially non-uniform and some components may be highly toxic, harmful, or air sensitive. Hence, continuous in situ monitoring is preferred over periodic removal of discrete samples. The plasma probe described in the present teachings provides a convenient means of in situ monitoring by mass spectrometry. The probe may be mounted on a suitable flange with a seal. Elevated pressures can be accommodated by increasing the pressure of the gas supplied to the bubble as previously described.

While exemplary arrangements have been described herein to assist in an understanding of the present teaching it will be understood that modifications can be made without departing from the spirit and or scope of the present teaching. To that end it will be understood that the present teaching should be construed as limited only insofar as is deemed necessary in the light of the claims that follow. Furthermore, the words comprises/comprising when used in this specification are to specify the presence of stated features, integers, steps or components but does not preclude the presence or addition of one or more other features, integers, steps, components or groups thereof.

The invention claimed is:

1. A mass spectrometry system comprising a mass spectrometer and a plasma probe, the probe being configured to effect an introduction of gas into the mass spectrometer, the probe comprising:

a first gas conduit having an inlet and an outlet, the outlet of the first gas conduit being provided at a sampling region of the probe;

a second gas conduit having an inlet and an outlet; and at least one electrode of a plasma generator;

wherein:

the first gas conduit inlet is configured to operatively couple with a gas source to effect a transport of gas from the gas source to the outlet of the first gas conduit, the probe being configured such that operatively, on immersion of the sampling region of the probe in a liquid, the flow of gas through the first gas conduit effects formation of a bubble extending from the sampling region of the probe, the bubble being at least partly defined by a gas-liquid interface;

the second gas conduit inlet is arranged relative to the first gas conduit outlet such that on formation of the bubble, the second gas conduit inlet is arranged to receive gas supplied through the first gas conduit; and the at least one electrode is configured such that on coupling to a power source, a plasma is operatively provided within the bubble, the second gas conduit being arranged to effect a transport of one or more ionised analytes resultant from the plasma from its inlet to a mass spectrometer provided at its outlet; and wherein the system further comprises a control module configured to effect a control of the gas flow through at least the first gas conduit to maintain a formed gas bubble.

2. The system of claim 1 wherein the second gas conduit inlet is co-located with the first gas conduit outlet.

3. The system of claim 1 wherein second gas conduit is coaxial with the first gas conduit.

4. The system of claim 1 wherein the second gas conduit is at least partially defined within the first gas conduit.

5. The system of claim 1 wherein the first gas conduit is at least partially defined within the second gas conduit.

6. The system of claim 1 wherein the probe is co-operable with a body defining an orifice, each of the first gas conduit and the second gas conduit being receivable into the orifice, the bubble operatively being formed across the orifice.

7. The system of claim 1 wherein one of the conduits define an outermost conduit of the probe, the bubble being operatively attached to a rim of the outermost conduit.

8. The system of claim 1 further comprising at least one electrode provided on at least one of the first gas conduit or the second gas conduit.

9. The system of claim 8 wherein the first gas conduit comprises a first electrode and the second gas conduit comprises a second electrode, the first and second electrode being configured to operatively generate a dielectric barrier discharge to effect provision of a plasma within the bubble.

10. The system of claim 1 comprising a first and second electrode, the first and second electrode being configured to effect generation of a plasma.

11. The system of claim 1 comprising an acoustic generator configured to effect generation of acoustically-driven bubble pulsations.

12. The system of claim 1 wherein the control module is configured to maintain the formed gas bubble at a predetermined size.

13. The system of claim 12 wherein the predetermined size is at least a predetermined minimum size.

14. The system of claim 1 wherein the control module is configured to control the flow of gas through at least the first gas conduit such that operatively, the gas flow from the gas source equals the gas flow into the second gas conduit.

15. The system of claim 1 being configured such that a static or dynamic mode stream of bubbles operatively issues from the first gas conduit such that a gas bubble is continuously provided extending from the sampling region of the probe.

16. The system of claim 1 comprising a feedback circuit comprising a transducer and a control module, the transducer being configured to provide a signal to the control module.

17. The system of claim 16 wherein the transducer operatively detects defined characteristics of the bubble, the characteristics being selected from at least one of size, pressure, and position of the gas-liquid interface.

18. The systems of claim 16 wherein the control module is configured to vary an applied gas pressure or flow rate according to the signal provided by the transducer.

19. The system of claim 1 wherein the control module is configured to periodically effect modulation in a size of the bubble.

20. The system of claim 16 wherein the transducer is configured to detect at least one of:

a. reflection or refraction of light, b. scattering or absorption of sound, c. changes in inductance, d. changes in capacitance, or e. changes in pressure.

21. The system of claim 16 wherein the transducer comprises a video camera.

22. The system of claim 16 wherein the transducer is configured to detect variations in light emitted by the plasma.

23. The system of claim 16 wherein the transducer is configured to detect internal reflection of light or sound within the bubble.

24. The system of claim 17 wherein the transducer is located within the gas flow path.

25. The system of claim 16 wherein the control module optimises a figure of merit by varying a size of the bubble and/or a discharge characteristic of the plasma.

26. The system of claim 25 wherein the figure of merit is the signal level, signal-to-noise ratio and/or signal stability.

27. The system of claim 1 further comprising a liquid reservoir within which a liquid to be analysed is operatively provided.

28. The system of claim 1 configured to operatively form the plasma by a dielectric barrier discharge.

29. The system of claim 1 configured to operatively form the plasma by a silent, corona, glow, arc, or microwave discharge.

30. The system of claim 1 comprising a piezoelectric transformer configured to operatively form the plasma.

31. The system of claim 1 wherein the probe comprises a first electrode and a second electrode of the plasma generator is provided separate to the probe.

32. The system of claim 31 wherein the second electrode is provided within a liquid reservoir.

33. The system of claim 1 comprising a flow cell defining a flow cavity.

34. The system of claim 33 wherein a longitudinal dimension of the bubble is determined by a depth of the flow cavity and a radial dimension of the bubble is defined by the gas-liquid interface.

35. The system of claim 33 wherein the flow cell comprises an inlet port and an outlet port arranged to effect a flow of liquid through the flow cavity, the probe being in fluid communication with the flow cavity and wherein operatively, liquid passes around a perimeter of the bubble as it flows from the inlet port to the outlet port.

36. The system of claim 35 wherein the flow cell is integrated with a mass spectrometer vacuum interface.

37. The system of claim 1 comprising a valve to operatively prevent liquid being drawn into the mass spectrometer.

38. The system of claim 1 comprising an acoustic source configured to induce bubble pulsations.

39. A sampling and ionisation method for mass spectrometry, the method comprising:

providing a probe comprising a first and a second gas conduit;

providing a mass spectrometer in communication with the second gas conduit;

providing a gas source in fluid communication with the first gas conduit; and providing a plasma generator;

immersing at least a portion of the probe into a liquid such that gas from the gas source flows through the first conduit and into a bubble at least partly defined by a gas-liquid interface;

using the plasma generator to effect provision of a plasma within the bubble; and allowing gas from the bubble to flow through the second conduit and thereafter into the mass spectrometer.

40. The method of claim 39 wherein the bubble is formed within a liquid and wherein one or more analytes are dissolved in the liquid.

41. The method of claim 40 wherein the plasma causes one or more analytes to be transferred from the liquid to the gas within the bubble.

42. The method of claim 40 wherein the plasma causes ionisation of the one or more analytes.

43. The method of claim 42 wherein the one or more ionised analytes become entrained in the gas flowing from the bubble to the mass spectrometer.

44. The method of claim 40 wherein a detection sensitivity and/or selectivity is altered by the addition of a chemical modifier to the liquid.

45. The method of claim 39 further comprising acoustically-driving bubble pulsations to effect a mixing of liquid proximate to the bubble.

* * * * *